US006054965A

United States Patent [19]

Yamamoto

[11] Patent Number: 6,054,965

[45] Date of Patent: Apr. 25, 2000

[54] EXTERNAL ANTENNA DEVICE FOR SHORT-WAVE RECEIVERS

[75] Inventor: Hitoshi Yamamoto, Kanagawa, Japan

[73] Assignee: Sony Corporation, Tokyo, Japan

[21] Appl. No.: 09/019,826

[22] Filed: Feb. 6, 1998

[30] Foreign Application Priority Data

Feb. 20, 1997 [JP] Japan ..... 9-035843

[51] Int. Cl.[7] ..... H01Q 1/50; H01Q 21/00

[52] U.S. Cl. ..... 343/860; 343/855; 343/748

[58] Field of Search ..... 343/850, 855, 343/860, 866, 870, 748, 713

[56] References Cited

U.S. PATENT DOCUMENTS

| | | | |
|---|---|---|---|
| 3,818,480 | 6/1974 | West | 343/749 |
| 4,381,566 | 4/1983 | Kane | 343/747 |
| 4,573,053 | 2/1986 | Mori et al. | 342/441 |
| 4,789,866 | 12/1988 | Ohe et al. | 343/712 |
| 4,804,968 | 2/1989 | Ohe et al. | 343/713 |
| 5,243,356 | 9/1993 | Hama | 343/748 |

FOREIGN PATENT DOCUMENTS 0367555 5/1990 European Pat. Off. .

0506333 9/1992 European Pat. Off. .

*Primary Examiner*—Don Wong
*Assistant Examiner*—Hoang Nguyen
*Attorney, Agent, or Firm*—Lay H. Maioli

[57] ABSTRACT

An external antenna device for receiving short-wave broadcasts includes an antenna circuit section consisting of a tuner in which a loop antenna element and a variable-capacity diode are high-frequency-connected to each other in parallel, and a high-frequency amplifier supplied with receive signals selected by the tuner; a first cable for connecting the antenna circuit section to a control unit; a control voltage forming circuit for generating a control voltage for the variable-capacity diode provided in the control unit, and a power source for the antenna circuit section and the control voltage forming circuit; wherein a voltage from the power source and the control voltage are supplied to the antenna circuit section via the first cable and, at the same time, a second cable for supplying a short-wave receiver with signals resulting from the passage of the output signals of the high-frequency amplifier through the first cable and control unit is provided between the control unit and the short-wave receiver

3 Claims, 5 Drawing Sheets

EXTERNAL ANTENNA DEVICE FOR SHORT-WAVE RECEIVERS

BACKGROUND OF THE INVENTION

1. Field of the Invention

The present invention relates to an external antenna device for receiving short-wave broadcasts.

2. Description of the Related Art

Portable short-wave receivers are usually equipped with a rod antenna, which, however, is insufficient by itself in reception sensitivity. To enhance reception sensitivity some short-wave receivers are disposed to permit connection of an external antenna.

Known examples of such external antennas include a wire antenna and a combination of another rod antenna with a high-frequency amplifier. A wire antenna, which may be either a simple wire or a lead supplying the signals it has received as they are to the receiver, can achieve the required level of sensitivity if it is long enough. An active antenna combined with a high-frequency amplifier can also achieve the required level of sensitivity.

However, because a wire antenna is non-directional, it supplies the receiver with unnecessary radio wave signals, too, and accordingly is disadvantageous respect to interference characteristics.

An active rod antenna, if it is made compact by reducing the length, may become inadequate in sensitivity even if it is combined with a high-frequency amplifier or, if it is made long enough to be sufficiently sensitive, its overall size will inevitably increase. Furthermore, the relatively low directivity makes the rod antenna also disadvantageous in interference characteristics and other respects.

The present invention is intended to solve the problems noted above.

SUMMARY OF THE INVENTION

According to the invention, there is provided an external antenna device for short-wave receivers comprising:

an antenna circuit section;

a control unit;

a first cable for connecting the antenna circuit section and said control unit; and a second cable for connecting the control unit and the external antenna terminal of a short-wave receiver, wherein:

the antenna circuit section is provided with:

a tuner consisting of a loop antenna and a variable-capacity diode which are high-frequency-connected to each other in parallel, and a high-frequency amplifier supplied with receive signals selected by the tuner;

the control unit is provided with:

a controlled voltage forming circuit for generating a controlled voltage for the variable-capacity diode, and a power source for the antenna circuit section and the controlled voltage forming circuit;

a voltage from the power source and said controlled voltage are supplied to the antenna circuit section via the first cable and, at the same time, the output signals of said high-frequency amplifier are taken out from the second cable via the first cable and the control unit, and supplied to the short-wave receiver.

Therefore, the loop antenna is caused to receive radio wave signals, the tuner selects the receive frequency, and signals of that selected radio wave frequency are amplified by the high-frequency amplifier to be supplied to the short-wave receiver.

DETAILED DESCRIPTION OF THE PREFERRED EMBODIMENTS

Figure 1:
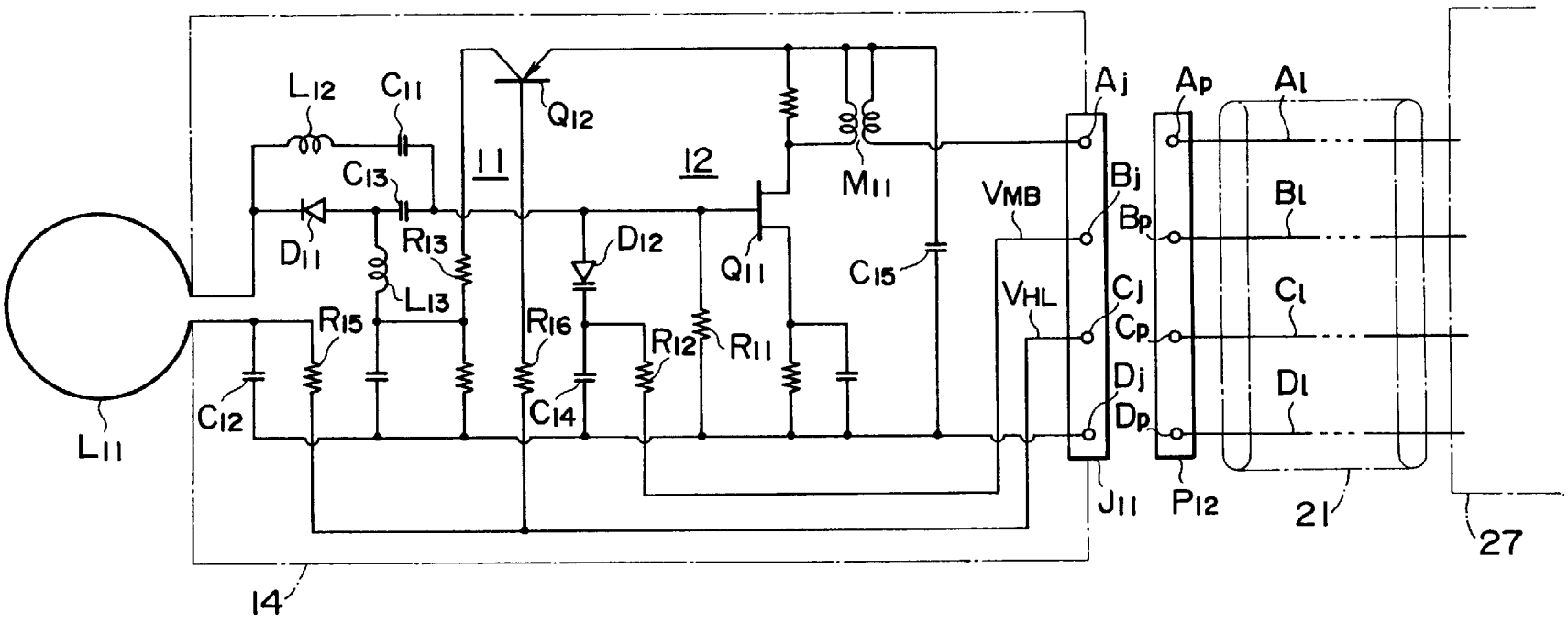
FIG. 1 is a connection diagram illustrating a part of a first preferred embodiment of the present invention.
Figure 2:
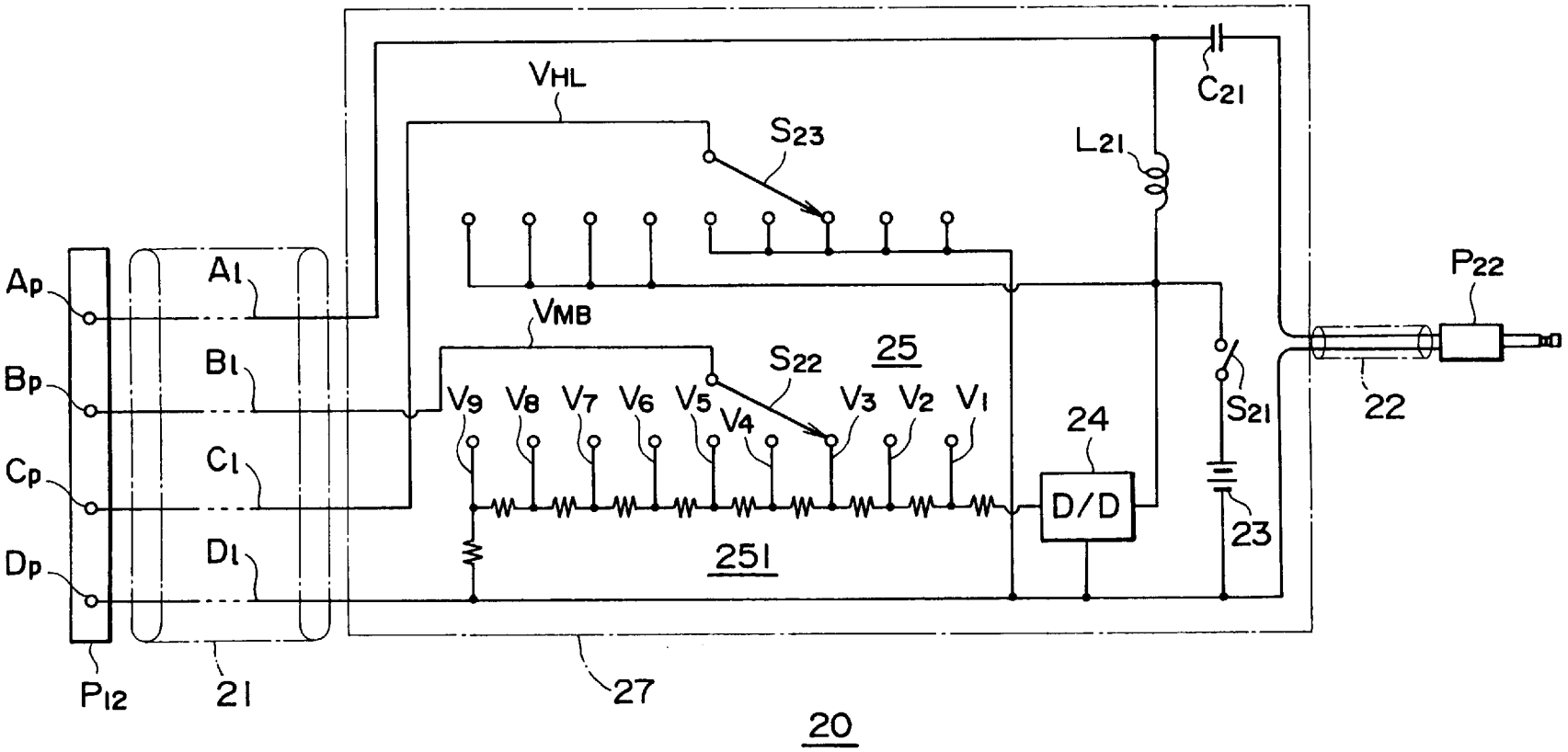
FIG. 2 is a connection diagram illustrating a part continuing from FIG. 1.

FIGS. 1 and 2 illustrate a first preferred embodiment of the invention, in which the invention is applied to an external antenna device whose reception bands range from 13 m to 75 m. In FIGS. 1 and 2, reference numeral 10 denotes an antenna circuit section and 20, a control unit.

As shown in FIG. 1, the antenna circuit section 10 is provided with a loop antenna element L11. This loop antenna element L11 is composed of an electroconductive and flexible or elastic wire, such as piano wire, in a circular overall shape. It may be, for example, a single-wound coil of 40 cm in diameter.

This loop antenna element (coil) L11, together with an auxiliary tuning coil L12 and a variable-capacity diode D12, constitutes an input tuner 11. Thus, one end of the loop antenna element L11 is connected to the gate of a field effect transistor (FET) Q11 via the coil L12 and a DC cutting capacitor C11, while the other end is connected to the ground contact Dj of a connector jack J11 via a bypass capacitor C12. To the series circuit of the elements L12 and C11 is connected in parallel another series circuit of a switching diode D11 and another DC cutting capacitor C13, and between the gate of the FET Q11 and the contact Dj of the jack J11 are connected in series the variable-capacity diode D12 and still another DC cutting condenser C14, together with a biasing resistor R11.

Further, the FET Q11, constituting a high-frequency amplifier 12, is source-grounded, and its drain is connected to one end of the primary coil of a high-frequency transformer M11, while the other end of the same is connected to the grounding contact of the jack J11 via a bypass capacitor C15. One end of the secondary coil of the transformer M11 is connected to a power supply contact Aj of the jack J11, while the other end of it is connected to the connection point between the second end of the primary coil and the capacitor C15.

The connection points between the respective second ends of the primary and secondary coils of the transformer M11 are connected to the emitter of a switching transistor Q12, whose collector is connected to the diode D11 via a resistor R13 and a high-frequency choke coil L13. Another contact Bj of the jack J11 is connected to the connection point between elements D12 and C14 via a buffering resistor R12, and still another contact Cj of the jack J11 is connected to the connection point between the antenna element L11 and a capacitor C12 via another buffering resistor R15 as well as to the base of the transistor Q12 via still another resistor R16.

Figure 3:
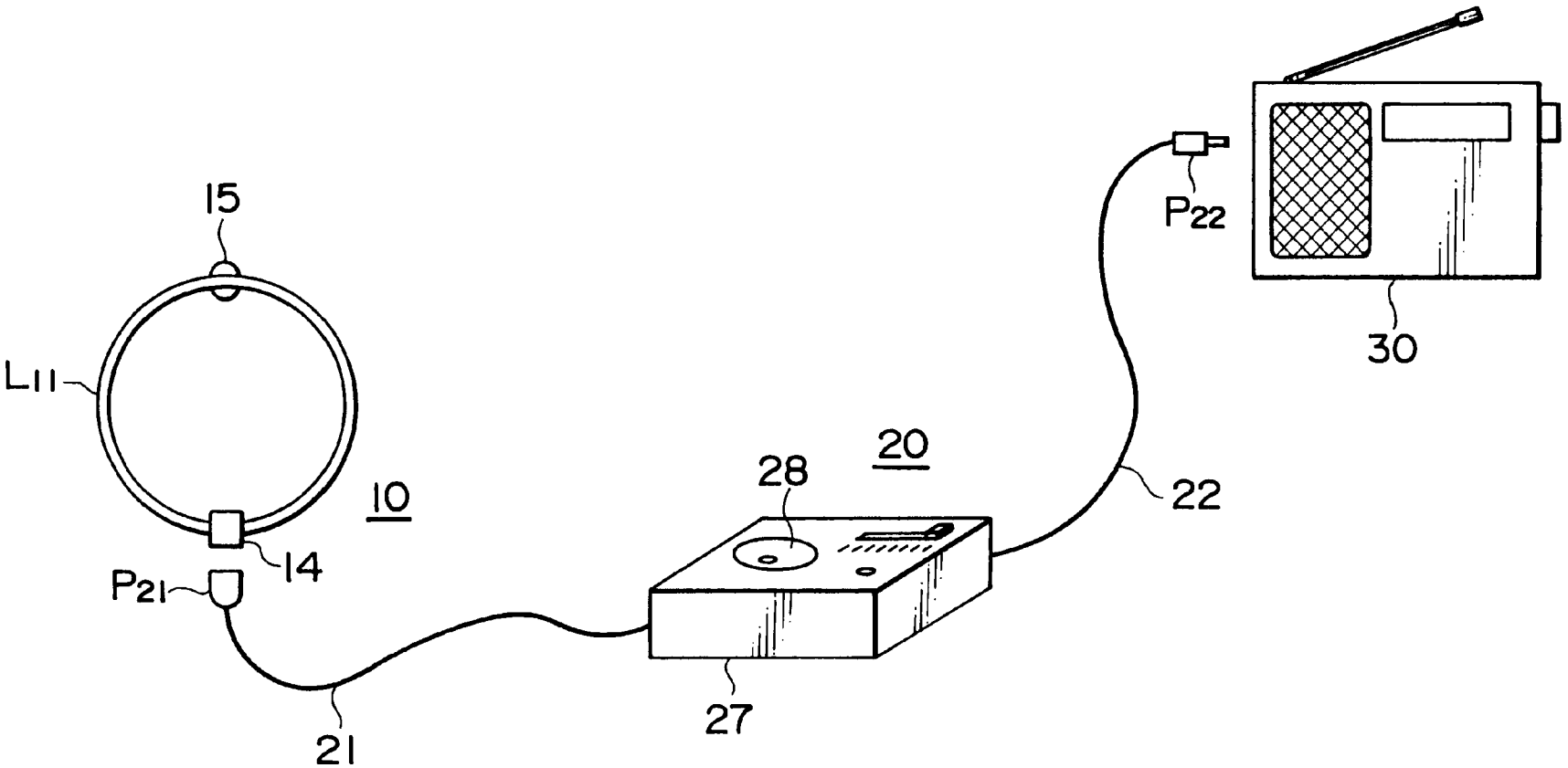
FIG. 3 illustrates an external view of the first preferred embodiment of the invention.

Meanwhile, to the control unit 20 are connected a connector plug P21 and a cable 21 both for connecting it to the antenna circuit section 10 and, as illustrated in FIG. 3, a cable 22 and a connector plug P22 both for connection to a short-wave receiver 30. In this disposition, as shown in FIG. 1, the plug P21 is intended for connection to the jack J11, and has contacts Ap to Dp which are to be respectively connected, when it is connected to the jack J11, to the contacts Aj to Dj of the jack J11. Incidentally, signs A1 to D1 denote leads which are arranged within the cable 21 and to be respectively connected to the contacts Ap to Dp.

As illustrated in FIG. 2, the contact Ap of the plug P21 is connected via the lead A1 of the cable 21 and further via a high-frequency choke coil L21 and a power switch S21 to a DC power source 23, which may consist of a couple of size 3 cells for example, and the connection point between the lead A1 and the choke coil L21 is connected via a DC cutting capacitor C21 and further via the cable 22 to the hot side contact of the plug P22. The contact Dp of the plug P21 is connected via the lead D1 of the cable 21 to the cells 23, and via the cable 22 to the grounding side contact of the plug P22.

The cell voltage obtained on the output side of the switch S21 is supplied to a DC-to-DC converter 24 to be boosted to a prescribed DC voltage and stabilized. This DC voltage is supplied to a control voltage forming circuit 25 to form a control voltage VMB for switching the meter band.

In the illustrated example, the control voltage forming circuit 25 consists of a resistance type voltage divider 251 for forming first to ninth divided voltages V1 to V9 and a switch S22 for selecting and taking out one of the divided voltages V1 to V9. One or another of the voltages V1 to V9 is taken out as control voltage VMB, which is supplied via the lead B1 of the cable 21 between the contacts Bp and Dp of the plug P21. The voltages V1 to V9 are consecutively lower in the ascending order of the reference numerals.

The embodiment illustrated in FIG. 2 is further provided with a switch S23 interlocked with the switch S22. From this switch S23 is taken out a voltage VHL whose level is at "0" when the switch S22 is in a switching position for VMB=V1 to V5 and at "1" when it is in a switching position for VMB=V6 to V9. This voltage VHL is supplied via the lead C1 of the cable 21 between the contacts Cp and Dp of the plug P21.

FIG. 3 illustrates an example of the shape and the form of use of the above-described device. At the end of the loop antenna element L11 is provided a box 14, which houses all other circuits of the antenna circuit section 10 than the loop antenna element L11, including the circuits 11 and 12 and the jack J11 The loop antenna element L11 is provided with a suction device 15 for enabling it to hold on to a window pane or the like.

The control unit 20 is also housed in a box 27, from which the cables 21 and 22 are drawn out. By turning a knob 28, a reel (not shown) within the box 27 is rotated to wind the cable 21 into the box 27. The reception bands of the short-wave receiver 30 range from 75 m to 13 m. Of course, this box 27 is also provided with a knob to operate the power switch S21 and another to switch the reception band within the 75–13 m range.

In this configuration, when a short-wave broadcast is to be received, the plug P21 is inserted into the jack J11, and the plug P22 is inserted into the input jack (not shown) of the receiver 30 for the external antenna. The loop antenna element L11 is arranged in a favorable position for receiving radio waves, such as beside a window, to which the loop antenna element L11 can be attached with the suction device 15.

When the power switch S21 is turned on, the DC voltage from the cells 23 is supplied to the high-frequency amplifier 12 over a power line consisting of the switch S21, high-frequency coil L21, lead A1 of the cable 21, contacts Ap (and Dp) of the plug P21 and contacts Aj (and Dj) of the jack J11 in that order. The high-frequency amplifier 12 is thereby enabled to perform its amplifying function.

As the switch S21 is on, a DC voltage is supplied from the DC-to-DC converter 24, and a controlled voltage of a level corresponding to the switched position of the switch S22 is supplied from the control circuit 25.

This controlled voltage VMB is supplied to the variable-capacity diode D12 over a line consisting of the control circuit 25, lead B1 of the cable 21, contact Bp of the plug P21, contact Bj of the jack J11, resistor R12, variable-capacity diode D12, resistor R11, contact Dj of the jack J11, contact Dp of the plug P21, lead D1 of the cable 21 and control circuit 25 in that sequence. Therefore, the capacity of the variable-capacity diode D12 takes on a value corresponding to the controlled voltage VMB.

If VMB=V1 to V5, VHL="0" and, as this voltage VHL is supplied to the base of the transistor Q12 via a line consisting of the lead C1 of the cable 21, contact Cp of the plug P21, contact Cj of the jack J11 and the resistor R16 in that order, the transistor Q12 is turned on.

Therefore, as the DC voltage supplied to the high-frequency amplifier 12 is further supplied to a line consisting of the emitter-collector connection of the transistor Q12, resistor R13, high-frequency choke coil L13, a diode D11, the loop antenna element L11, resistor R15 and contact Cj of the jack J11 (VHL="0") in that sequence, the diode D11 is turned on.

As a result, the coil L12 is short-circuited by the diode D11, the loop antenna element L11 and the variable-capacity diode D12 are high-frequency-connected to each other in parallel, and this parallel circuit is connected between the gate and source of the FET Q11. Accordingly, in the tuner 11, the frequency determined by the values of the loop antenna element L11 and of the variable-capacity diode D12 takes on a tuned frequency level of f11, and receive signals of that frequency f11 are amplified by the FET Q11.

The amplified receive signals are taken out at the drain of the FET Q11, and further supplied to the receiver 30 via a line consisting of the secondary coil of the transformer M11, contact Aj of the jack J11 (and the capacitor C15, contact Dj), contacts Ap (and Dp) of the plug P21, lead A1 of the cable 21, capacitor C21, cable 22 and plug P22.

As at this time the capacity of the variable-capacity diode D12 varies corresponding to the control voltage VMB, the tuned frequency f11 of the tuner 11 also varies corresponding to the control voltage VMB in the following manner, for instance:

When VMB=V1, f11=13 m to 15 m band

When VMB=V2, f11=16 m to 19 m band

When VMB=V3, f11=22 m band

When VMB=V4, f11=25 m band

When VMB=V5, f11=31 m band

Therefore, in the present case, receive signals from the 13 m band to the 31 m band can be received, and the tuned frequency can be switched from one meter band to another.

Then, when VMB=V6 to V9, VHL="1" and, as this voltage VHL is supplied as stated above to the base of the transistor Q12, the transistor Q12 is turned off, and accordingly the diode D11 is also turned off.

As a result, the coil L12 is high-frequency-connected in series to the loop antenna element L11, this series circuit is high-frequency-connected to the variable-capacity diode D12 in parallel, and this parallel circuit is connected between the gate and source of the FET Q11. Therefore, in the tuner 11, the frequency determined by the values of the coils L13 and L12 and of the variable-capacity diode D12 takes on a tuned frequency level of f11, and receive signals of that frequency f11 are amplified by the FET Q11. The amplified receive signals are supplied, as described above, to the receiver 30 via the control unit 20.

As at this time the capacity of the variable-capacity diode D12 varies correspondingly to the control voltage VMB, the tuned frequency f11 of the tuner 11 also varies correspondingly to the control voltage VMB in the following manner, for instance:

When VMB=V6, f11=41 m band

When VMB=V7, f11=49 m band

When VMB=V8, f11=60 m band

When VMB=V9, f11=75 m band

Therefore, in the present case, receive signals from the 41 m band to the 75 m band can be received, and the tuned frequency can be switched from one meter band to another.

Thus, as the control voltage VMB is varied, i.e. as the switches S22 and S23 are turned, one of the 13 m to 75 m bands is selected on a meter-band-by-meter-band basis according to the way they are turned, so that received signals of the selected band can be amplified and supplied to the short-wave receiver 30.

Accordingly, the desired short-wave broadcast can be received at high sensitivity. In this case, especially with the above-described device, unnecessary radio wave signals are not received downstream, resulting in improved interference characteristics, because the tuner 11 is provided to achieve selectivity regarding the receive frequency.

Furthermore, because the loop antenna element L11 is used as receiving antenna, the reception sensitivity can be enhanced with a smaller configuration than that of a separate rod or wire antenna. There is the additional advantage that the loop antenna element Lll can be hung on a hook or the like or, if the suction device 15 is used, attached to a window or the like where the condition for reception is favorable.

Moreover, if the loop antenna element L11 is arranged in a favorable position for reception, such as on a window, the meter band can be selected from the control unit 20 placed close to the receiver 30. Further, the directivity of the loop antenna element L11 can be utilized to improve interference characteristics.

Figure 4A:
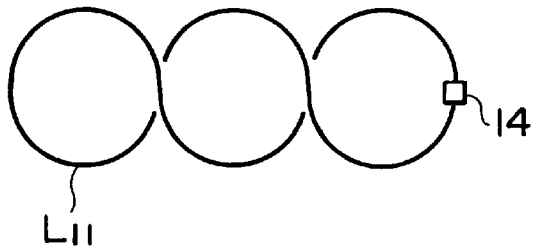
FIG. 4 comprises diagrams to facilitate description of the invention.
Figure 4B:
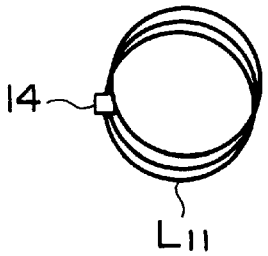

There is a further advantage that, as the loop antenna element L11 is composed of a flexible or elastic wire, such as piano wire, it can be reduced in overall size and made more convenient to carry by twisting it into three adjoining circles as illustrated in FIG. 4A and, as shown in FIG. 4B, folded to bring the three circles together. In addition, the plug P21 can be pulled off the jack J11, and the cable 21 can be wound into the box 27 by turning the knob 28. Therefore, this antenna device can be readily carried together with the receiver 30 if it is portable.

Figure 5:
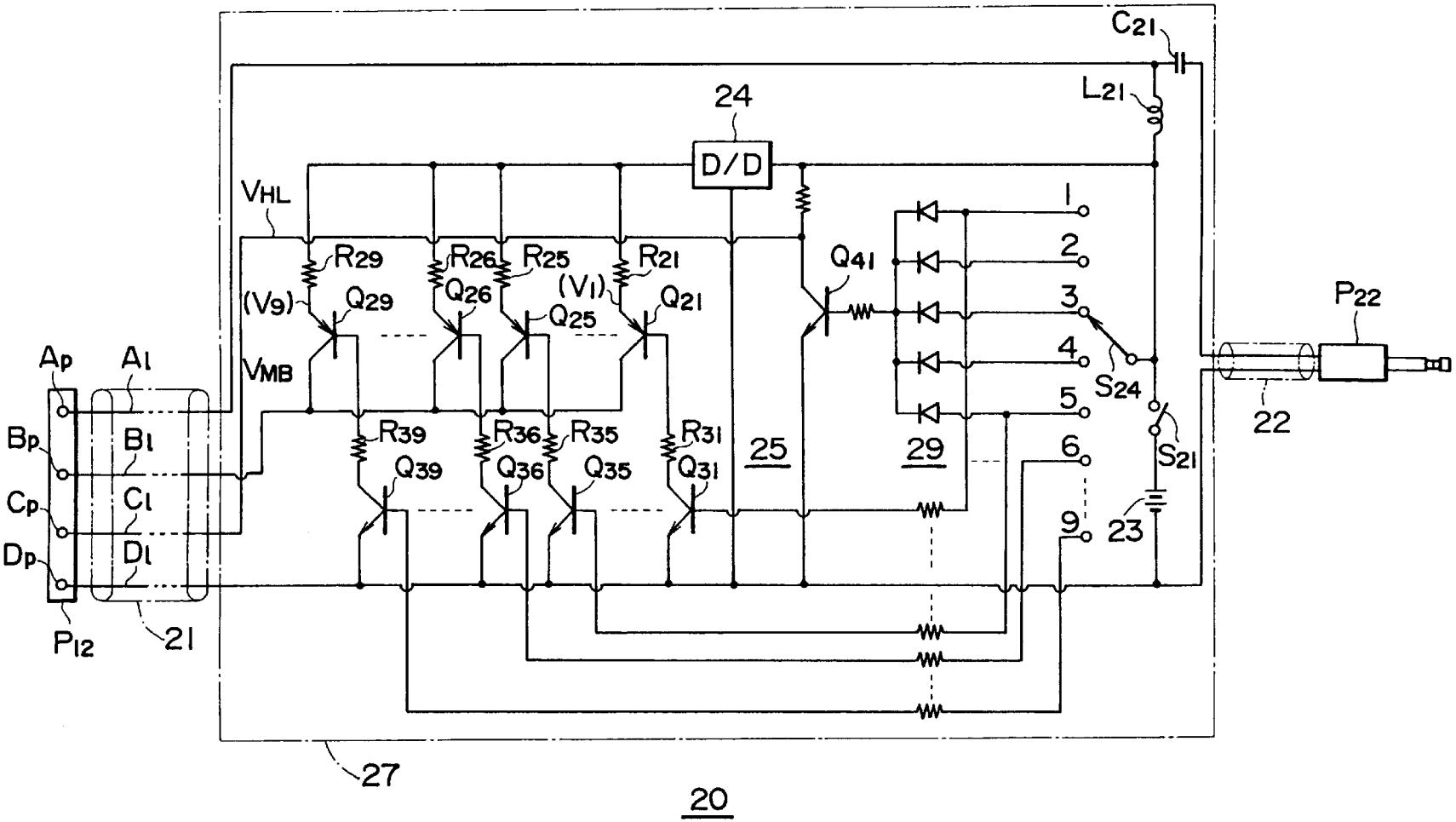
FIG. 5 is a connection diagram illustrating a part of a second preferred embodiment of the invention.

FIG. 5 illustrates the control unit 20 in a second preferred embodiment of the present invention. The same constituent elements as in the first embodiment are assigned respectively the same reference signs, and their detailed description is dispensed with. To the output side of a DC-to-DC converter 24 in this second embodiment are connected in series resistors R21 to R29 and the emitters and collectors of transistors Q21 to Q29, and from the emitters is taken out a voltage VMB, which is supplied to the contact B of the plug P21 via the cable P21. The resistors R21 to R29 have resistances matching the voltages V1 to V9, respectively.

Between the bases of the transistors Q21 to Q29 and the lead of the cable 21 connected to the contact Dp of the plug 21 are connected in series the resistors R31 to R39 and the collector-emitter connections of transistors Q31 to Q39.

There further is provided the switch S24 for switching the meter band, and the voltage from the cells 23 is selectively taken out to one of the first to ninth child contacts. The taken-out voltage is supplied to the base of the corresponding one of the transistors Q31 to Q39.

Further, a voltage obtained at one of the first to fifth child contacts of the switch S24 is supplied to the base of an emitter-grounded transistor Q41 via OR circuits 29 consisting of diodes, and the collector output of the transistor Q41 is taken out as voltage VHL and supplied to the contact Cp of the plug P21 via the cable 21.

In this configuration, when the parent contact of the switch S24 is connected to, for instance, the first child contact, the transistor Q31 is turned on and thereby causes the transistor Q21 to be turned on Accordingly, a voltage V11 corresponding in level to the resistor R21 is taken out at the collector of the transistor Q21, and this voltage V11 is supplied at the contact Bp of the plug P21 as voltage VMB.

Similarly, when the parent contact of the switch S24 is connected to one of the second to ninth child contacts, the corresponding one of the transistors Q32 to Q39 is turned on and thereby causes the corresponding one of the transistors Q22 to Q29 to be turned on. Accordingly, voltages V2 to V9 corresponding in level to the resistors R22 to R29 are taken out at the collectors of the transistors Q22 to Q29, and these voltages V2 to V9 are supplied at the contact Bp of the plug P21 as voltage VMB.

When the parent contact of the switch S24 is connected to one of the first to fifth child contacts, the transistor Q41 is then on, the voltage VHL, which is its collector output, is "0" and this voltage VHL is supplied to the contact Cp of the plug P21.

Then, when the parent contact of the switch S24 is connected to one of the fifth to ninth child contacts, as the transistor Q41 is then off, the voltage VHL, which is its collector output, is "1" and this voltage VHL is supplied to the contact Cp of the plug P21.

Therefore, as the voltages VMB and VHL vary in the same way as in the case of FIG. 2 correspondingly to the position to which the switch S24 is turned, the antenna circuit section 10 can select a meter band according to the voltages VMB and VHL, amplify receive signals of that meter band and supply them to the receiver 30.

Since the present invention provides selectivity regarding the receive frequency, characteristics against interference by unneeded signals are improved. The invention can also help reduce the size and enhance the reception sensitivity of the antenna. Furthermore, it enables the antenna to be arranged in a favorable position for reception, such as beside a window. Moreover, the directivity of the antenna can be utilized to improve interference characteristics. Furthermore, the antenna can be readily carried together with the short-wave receiver, if it is portable.

What is claimed is:

1. An external antenna device for receiving short-wave broadcasts comprising:

an antenna circuit section and a control unit;

the antenna circuit section having a tuner consisting of a loop antenna and a variable-capacity diode which are high-frequency-connected to each other in parallel, and a high-frequency amplifier supplied with received signals selected by said tuner;

a first cable for connecting said antenna circuit section and said control unit; and a second cable for connecting said control unit and an external antenna terminal of a short-wave receiver;

the control unit having a controlled voltage forming circuit for generating a controlled voltage for said variable-capacity diode, and a power source for said antenna circuit section and said controlled voltage forming circuit so that a voltage from said power source and said controlled voltage are supplied to said antenna circuit section, wherein output signals from the high-frequency amplifier are taken out from said second cable, via said first cable and said control unit, and supplied to the short-wave receiver.

2. An external antenna device for receiving short-wave broadcasts, comprising:

an antenna circuit section;

a control unit;

a first cable for connecting said antenna circuit section and said control unit; and a second cable for connecting said control unit and an external antenna terminal of a short-wave receiver, wherein:

said antenna circuit section includes:

a tuner consisting of a loop antenna element and a variable-capacity diode which are high-frequency-connected to each other in parallel, and a high-frequency amplifier supplied with received signals selected by said tuner;

said control unit includes:

a controlled voltage forming circuit for generating a controlled voltage for said variable-capacity diode, and a power source for said antenna circuit section and said controlled voltage forming circuit;

a voltage from said power source and said controlled voltage are supplied to said antenna circuit section via said first cable and, at the same time, output signals from said high-frequency amplifier are taken out from said second cable, via said first cable and said control unit, and supplied to said short-wave receiver.

3. The external antenna device for receiving short-wave broadcasts, as set forth in claim 2, wherein:

said antenna circuit section and said first cable are detachably connected to each other by a connector.

* * * * *